US007117782B2

(12) United States Patent
Murakami et al.

(10) Patent No.: US 7,117,782 B2
(45) Date of Patent: Oct. 10, 2006

(54) COMPRESSOR AND METHOD OF LUBRICATING THE COMPRESSOR

(75) Inventors: Kazuo Murakami, Kariya (JP); Yoshiyuki Nakane, Kariya (JP); Tatsuya Koide, Kariya (JP); Kenichi Morita, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 49 days.

(21) Appl. No.: 09/926,144

(22) PCT Filed: Dec. 11, 2000

(86) PCT No.: PCT/JP00/08761

§ 371 (c)(1),
(2), (4) Date: Oct. 19, 2004

(87) PCT Pub. No.: WO01/44661

PCT Pub. Date: Jun. 21, 2001

(65) Prior Publication Data

US 2005/0053480 A1 Mar. 10, 2005

(30) Foreign Application Priority Data

Dec. 17, 1999 (JP) ..... 11-358975

(51) Int. Cl.
*F01B 31/10* (2006.01)

(52) U.S. Cl. ..... 92/156; 92/71; 92/159

(58) Field of Classification Search ..... 92/12.2, 92/71, 154, 156, 158, 159; 417/222.2
See application file for complete search history.

(56) References Cited

U.S. PATENT DOCUMENTS 3,888,604 A * 6/1975 Oshima et al. ..... 417/269
4,321,019 A * 3/1982 Degawa et al. ..... 417/269
4,462,772 A * 7/1984 Hazaki et al. ..... 418/55.6
4,666,381 A 5/1987 Butterworth ..... 418/55
4,997,350 A * 3/1991 Tamura et al. ..... 418/55.6
5,181,834 A * 1/1993 Ikeda et al. ..... 92/71
5,580,224 A 12/1996 Ikeda et al. ..... 417/269
5,636,974 A * 6/1997 Ikeda et al. ..... 92/154
5,733,107 A * 3/1998 Ikeda et al. ..... 92/154
5,823,924 A * 10/1998 Summers ..... 482/125
6,129,532 A 10/2000 Kato et al. ..... 418/55.6
6,152,710 A 11/2000 Oh et al. ..... 417/570

FOREIGN PATENT DOCUMENTS

DE 195 20 267 A1 6/1995

(Continued)

*Primary Examiner*—Edward K. Look
*Assistant Examiner*—Michael Leslie
(74) *Attorney, Agent, or Firm*—Morgan & Finnegan, LLP

(57) ABSTRACT

A compressor is provided for guiding lubricating oil separated from the discharged refrigerant by an oil separator to a radial bearing supporting a drive shaft through an oil supply hole. A rotating member that rotates together with the drive shaft is provided adjacent to the radial bearing on the drive shaft, and lubricating oil is supplied to the radial bearing via a gap between an external surface of the rotating member and an internal surface of a circular hole that supports the rotating member. An oil support groove, which alternately communicates with the oil supply hole and the discharge hole every time the rotating member rotates once, is provided on the external surface of the rotating member, and the lubricating oil flowing in from the oil supply hole is intermittently discharged into a drive chamber via the groove and the discharge hole.

7 Claims, 4 Drawing Sheets

FOREIGN PATENT DOCUMENTS

| | | | |
|---|---|---|---|
| DE | 198 60 726 | A1 | 7/1999 |
| DE | 199 07 492 | A1 | 8/1999 |
| JP | 56-42757 | | 10/1981 |
| JP | 7-332239 | | 12/1995 |
| JP | 2531629 | | 1/1997 |
| JP | 11-241682 | | 9/1999 |

* cited by examiner

COMPRESSOR AND METHOD OF LUBRICATING THE COMPRESSOR

TECHNICAL FIELD

The present invention relates to a compressor that is ideal for a vehicle air-conditioning system, and more specifically to a lubrication technique that guides lubricating oil to lubrication target areas, such as the bearing of a drive shaft and the sliding surface between a piston and a cylinder bore.

BACKGROUND ART

A compressor that guides lubricating oil to the bearing of a drive shaft is disclosed, for example, in Japanese Laid-Open Patent Publication No. 7-27047. The compressor described in this publication is a swash plate compressor, in which a refrigerant gas that is discharged into a discharge chamber is guided to an oil separator provided in a cylinder block, thereby separating the lubricating oil from the refrigerant gas, and then the separated lubricating oil is guided to the bearing of a drive shaft via an oil supply hole provided in the cylinder block for lubrication.

The compressor configured as described above guides the oil separated from the discharged refrigerant to the bearing for lubrication, using the pressure difference between the oil separation chamber, which is at a higher pressure, and a drive chamber, which is at a lower pressure, and then returns the oil to the drive chamber. Consequently, if the diameter of the lubricating oil supply hole formed in the cylinder block is too large, leakage of the discharged refrigerant causes a degradation in performance, and leakage of a large amount of high-temperature lubricating oil heats the refrigerant that has been drawn in, thereby causing performance degradation. On the other hand, if the oil supply hole is too small, foreign substances, such as sludge (oil sludge), tend to clog the oil supply hole, and manufacturing such a small hole is also difficult.

Especially when a compressor uses carbon dioxide ($CO_2$) as the refrigerant, the operation pressure difference (the difference between a discharge pressure and a suction pressure) is large (5 MPa or greater) and therefore, said conflicting requirements become more difficult to satisfy.

The present invention has been developed in view of said existing problems, and its objectives are to prevent the clogging of the oil supply hole by foreign substances, such as sludge, and to avoid performance degradation caused by leakage of the discharged refrigerant.

DISCLOSURE OF THE INVENTION

In order to achieve the aforementioned objectives, a compressor relating to the present invention has a lubricating oil transport area that alternately communicates with an oil supply area and a lubrication target area, and the lubricating oil transport area can transport the lubricating oil from the oil supply area to the lubrication target area. In other words, the lubricating oil can be transported without directly connecting the oil supply area to the lubrication target area. Therefore, by making the hole diameter of the lubricating oil transport area sufficiently large, clogging by foreign substances can be prevented, and at the same time, performance degradation due to leakage of discharged refrigerant can be prevented by reducing leakage of the discharged refrigerant.

Note that in this case, the lubricating oil to be guided to the lubrication target area should preferably be a lubricating oil that has been separated from the discharged refrigerant by an oil separator, and should preferably be guided based on the pressure difference between a discharge side and a suction side of the compressor. Such a configuration is especially effective when applied to a compressor that uses carbon dioxide as the refrigerant.

If the lubricating oil transport area comprises a groove defined on the external surface of a rotating member, every time the rotating member rotates once, the groove defined on the external surface can receive the lubricating oil flowing from the oil supply area, transport it, and discharge the lubricating oil into a discharge hole. Therefore, clogging of the oil supply hole can be prevented, and at the same time, performance degradation due to leakage of discharged refrigerant can be prevented by reducing leakage of the discharged refrigerant.

In this case, it is preferable to provide the rotating member adjacent to a bearing that supports a drive shaft, such that the lubricating oil supplied from the oil supply area is guided to the bearing via the gap between the rotating member and a circular hole that supports said rotating member. When such a configuration is used, it is possible to adjust the volume of lubricating oil to be supplied to the bearing of the drive shaft by means of the gap.

If the lubricating oil transport area comprises a groove formed on the external surface of a piston, when the piston reciprocates inside a cylinder bore, the groove can discharge the lubricating oil supplied from the oil supply area to the lubrication target area by alternately communicating with the oil supply area and the lubrication target area. Therefore, clogging of the oil supply area can be prevented, and at the same time, performance degradation due to leakage of discharged refrigerant can be prevented by reducing leakage of the discharged refrigerant.

EMBODIMENTS OF THE INVENTION

Figure 1:
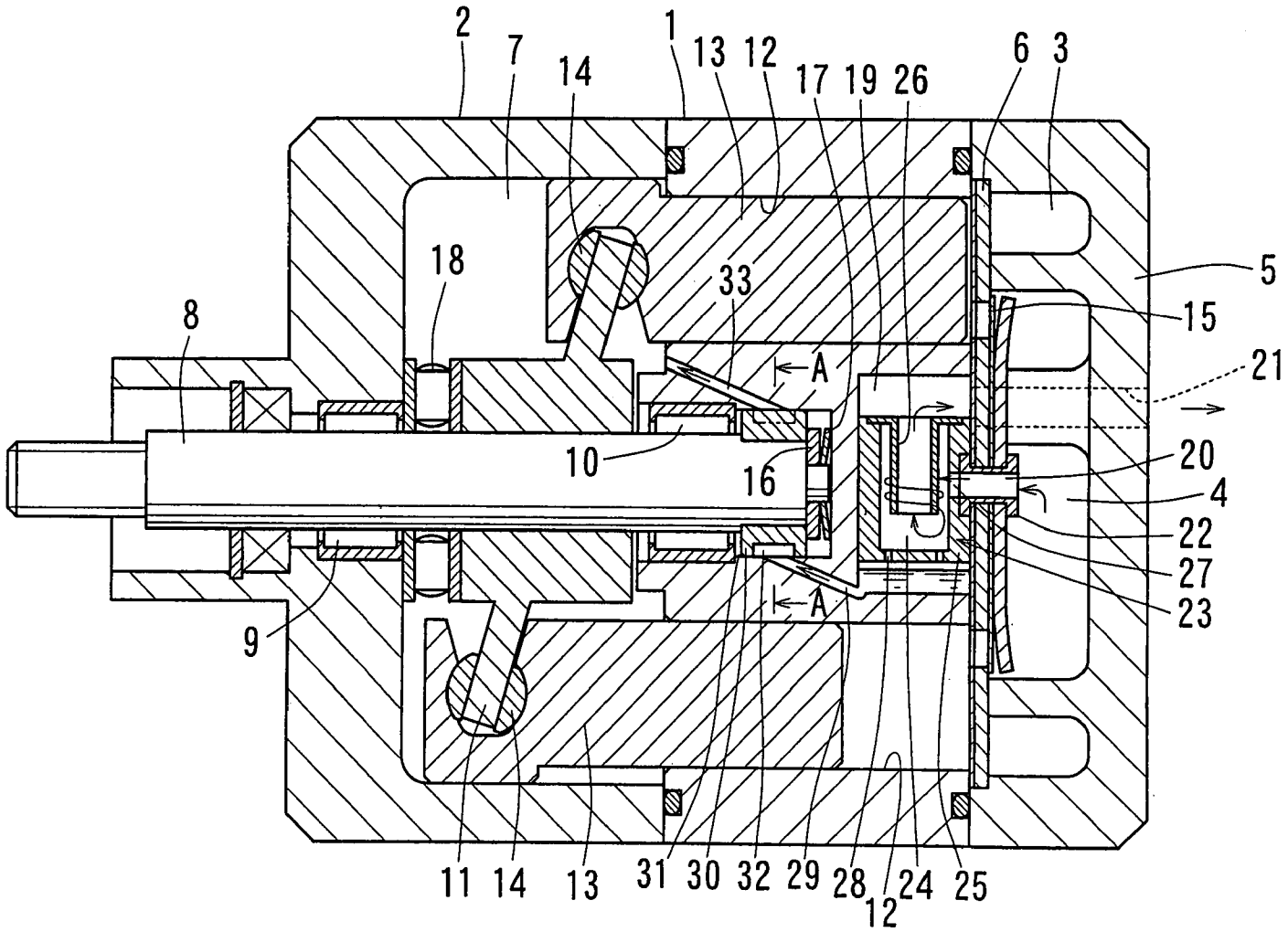
FIG. 1 is a cross-sectional diagram showing a compressor relating to the present embodiment.

Embodiments of the present invention will be explained below with reference to the drawings. The embodiments of the present invention are applied to a swash plate compressor, and as shown in FIG. 1, a front housing 2 is joined to the front end of a cylinder block 1, which comprises part of the external frame of the compressor; a rear housing 5, in which a suction chamber 3 and a discharge chamber 4 are defined, is joined to the rear end via a valve plate 6.

A drive shaft 8 that will be connected to a power source is inserted through a drive chamber 7 defined inside the front housing 2, and the drive shaft 8 is rotatably supported by the cylinder block 1 and the front housing 2 via radial bearings 9 and 10, respectively. A swash plate 11 is disposed inside the drive chamber 7 and is secured to the drive shaft 8. Note that the bottom of the drive chamber 7 comprises an oil reservoir where the lubricating oil collects, i.e., an oil collection chamber.

Moreover, the cylinder block 1 has multiple cylinder bores 12 that are bored at predetermined intervals in the circumferential direction, and a piston 13 is slidably fitted inside each of the cylinder bores 12. The base end of the piston 13 extends into the drive chamber 7, and at the same time, is coupled to the swash plate 11 via a shoe 14.

Therefore, when the drive shaft 8 is rotated, its rotational movement is converted into linear reciprocal movements of the piston 13 via the swash plate 11 and the shoe 14. Due to the reciprocal movements of the piston 13 inside the cylinder bore 12, the refrigerant inside suction chamber 3 is drawn into the cylinder bore 12 via an suction valve (omitted from the figure), and is discharged to the discharge chamber 4 via a discharge valve 15 after being compressed. The top portion of FIG. 1 shows the piston 13 at the top dead center (discharge completion position), while bottom portion shows the piston 13 at the bottom dead center (suction completion position).

A circular hole 31, one of whose ends opens to the drive chamber 7, is provided in the shaft core area of the cylinder block 1, and the radial bearing 10, which supports the drive shaft 8, as well as a rotating member 30, which will be described below, are positioned inside the circular hole 31; moreover, a thrust race 16 and a disc spring 17 for forwardly urging the rear end of the drive shaft 8 are disposed on the bottom of the hole 31. The urging force of the disc spring 17 is further supported by a thrust bearing 18, which is positioned between the swash plate 11 and the front housing 2.

A chamber 19 is defined in the center of the cylinder block 1, which faces the valve plate 6, and the chamber 19 communicates with the discharge chamber 4 via a first discharge channel 20 in approximately the mid-section in the vertical direction, and communicates with a cooling circuit, which is an external circuit, via a second discharge channel 21 on the top side. Note that the first discharge channel 20 is bored through a fixture 22 used for securing the discharge valve 15 to the valve plate 6.

A centrifugal separation oil separator 23, which separates the lubricating oil from the high-pressure refrigerant gas sent out to the cooling circuit via the chamber 19, is disposed inside the chamber 19. The oil separator 23 consists of a base 25, which has a separation chamber 24 that is in the shape of a circular hole with a bottom, and a flanged gas-guiding tube 26 installed in the base 25 so as to concentrically hang down from the upper opening edge of the separation chamber 24; a throughhole 27, which permits the separation chamber 24 to communicate with the first discharge channel 20, is provided on the side wall of the base 25. The throughhole 27 opens almost tangentially toward the inside of the separation chamber 24.

Therefore, the lubricating oil that is force-fed and guided into the separation chamber 24 together with the refrigerant by circling around the gas-guiding tube 26 from the first discharge channel 20 via the throughhole 27 collides with the perimeter wall of the separation chamber 24 due to centrifugal force, at the same time, is separated from the refrigerant and flows down, and collects on the bottom of the chamber 19 by passing through a throughhole 28 provided on the bottom wall of the separation chamber 24.

Further, the discharged refrigerant from which the lubricating oil has been separated is sent to the cooling circuit from the gas-guiding tube 26 via the second discharge channel 21.

An oil supply hole 29 for guiding the lubricating oil collected inside the chamber 19 to the radial bearing 10 of the drive shaft 8 is defined in the cylinder block 1. One end of the oil supply hole 29 opens to the bottom of the chamber 19 as an inlet and its other end opens as an outlet 29*a* to the part of the internal surface of the circular hole 31 that faces the external surface of the rotating member 30 (see FIGS. 2 and 3). The oil separator 23 and the oil supply hole 29 comprise the oil supply area.

The rotating member 30 is positioned adjacent to the radial bearing 10, is fitted by the width across flats on the rear end of the drive shaft 8 (see FIGS. 2 and 3), and rotates together with the drive shaft 8. The rotating member 30 is fitted into the circular hole 31 formed in the cylinder block 1, with a predetermined gap, and the oil supply hole 29 communicates with the side surface of the radial bearing 10 via this gap. Therefore, the gap is set such that an appropriate amount of lubricating oil for lubricating the radial bearing 10 is introduced.

Furthermore, a single groove (or a concave area) 32 for intermittently transporting the lubricating oil supplied via the oil supply hole 29 to the drive chamber 7, which is at a lower pressure, is defined on the outside of the rotating member 30, and the groove 32 comprises the lubricating oil transport area. A discharge hole 33 is defined in the cylinder block 1, and one end of the discharge hole 33 opens to the part of the internal surface of the circular hole 31 that faces the external surface of the rotating member 30, as an inlet 33*a*, while the other end opens to the drive chamber 7 as an outlet. Note that the inlet 33*a* of the discharge hole 33 is located in the position that is symmetric with the outlet 29*a* of the oil supply hole 29 across the center of the rotating member 30. Consequently, every time that the rotating member 30 is rotated once, the groove 32 alternately communicates with the oil supply hole 29 and the discharge hole 33 one time. The drive chamber 7 comprises the lubrication target area.

The compressor related to the embodiment of the present invention is configured as described above. Therefore, when the piston. 13, which is coupled to the swash plate 11 rotating with the drive shaft 8, reciprocates inside the cylinder bore 12, the compression work begins, and the refrigerant gas compressed by the piston 13 pushes open the discharge valve 15 and is discharged into the discharge chamber 4, and is then guided from the first discharge channel 20 into the chamber 19. Then, the lubricating oil contained in the refrigerant gas, which is introduced into the chamber 19, is separated from the refrigerant gas by centrifugal force inside the separation chamber 24, flows down the wall of the separation chamber 24 due to gravity, and collects via the throughhole 28 on the bottom of the chamber 19.

The lubricating oil collected inside the chamber 19 is supplied from the oil supply hole 29 via the gap between the external surface of the rotating member 30 and the internal surface of the circular hole 31 to the radial bearing 10 of the drive shaft 8, which has a lower pressure than the pressure (discharge pressure) inside the chamber 19, thereby lubricating the radial bearing 10.

Further, the discharged refrigerant, from which the lubricating oil has been separated inside the separation chamber 24, is transported to the cooling circuit from the gas-guiding tube 26 via the second discharge channel 21.

Figure 2:
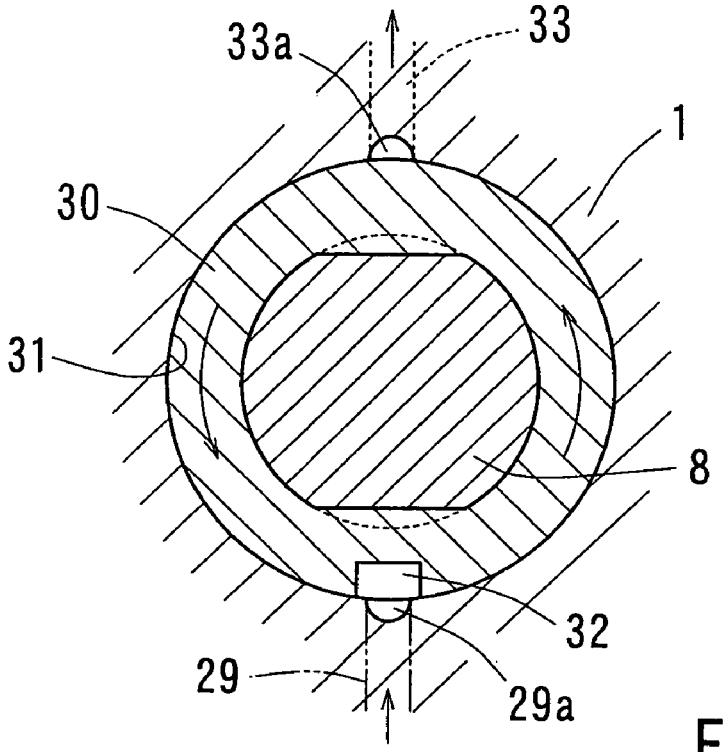
FIG. 2 is a magnified cross-sectional diagram taken along line A—A in FIG. 1, showing the state in which the groove for discharging oil communicates with the oil supply hole.
Figure 3:
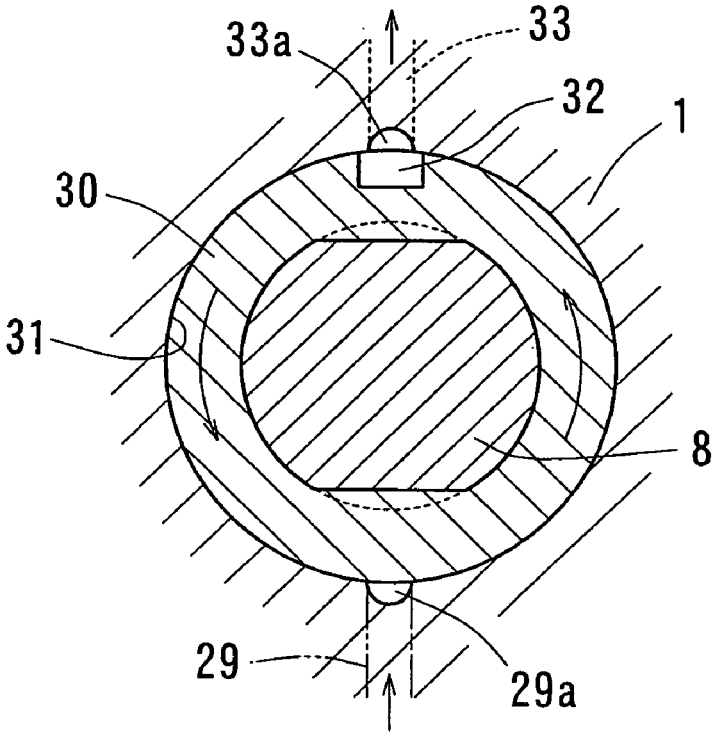
FIG. 3 is a magnified cross-sectional diagram along line A—A in FIG. 1, showing the state in which the groove for discharging oil communicates with the discharge hole.

The lubricating oil that has flowed in from the oil supply hole 29 flows into the groove 32 on the exterior surface of the rotating member 30 when the rotating member 30 is rotated together with the drive shaft 8, connecting the groove 32 to the outlet 29*a* of the oil supply hole 29, as shown in FIG. 2. Then, as shown in FIG. 3, when the groove 32 rotates by 180 degrees and connects to the inlet 33*a* of the discharge hole 33, the lubricating oil is discharged into the drive chamber 7, which is at a lower pressure, and is collected in the collection chamber on the bottom of the drive chamber 7.

That is, whenever the rotating member 30 rotates once, the groove 32 of the rotating member 30 receives the lubricating oil inside the oil supply hole 29 and discharges the lubricating oil to the drive chamber 7 via the discharge hole 33. By actively performing such intermittent discharging of the lubricating oil to the drive chamber 7, the sliding surface between the swash plate 11 and the shoe 14 inside the drive chamber 7 can be lubricated. Moreover, because the groove 32 is designed to intermittently communicate with the drive chamber 7, the amount of lubricating oil to be discharged by the groove 32 can be appropriately adjusted based on the size of the groove 32. Furthermore, because the oil supply hole 29 is never directly connected to the discharge hole 33, sudden refrigerant entry can be reliably prevented even when the pressure difference between the drive chamber 7 and the discharge chamber 4 is large.

Thus, the present embodiment can prevent clogging of the oil supply hole 29 by avoiding the stagnation of foreign substances, and can prevent performance degradation caused by leakage of the discharged refrigerant by reducing leakage of the discharged refrigerant. Note that if the oil supply hole 29 is large, the boring process can be easily performed.

The present invention becomes more effective when applied to a compressor that uses carbon dioxide ($CO_2$) as the refrigerant and that reaches an extremely high pressure.

In the present embodiment, the lubricating oil supplied from the oil supply hole 29 is supplied to the radial bearing 10 via the gap between the rotating member 30 and the circular hole 31, and therefore, it is possible to adjust the volume of oil to be supplied to the radial bearing 10 based on the gap, leaving more freedom for setting the diameter of the oil supply hole 29.

Figure 4:
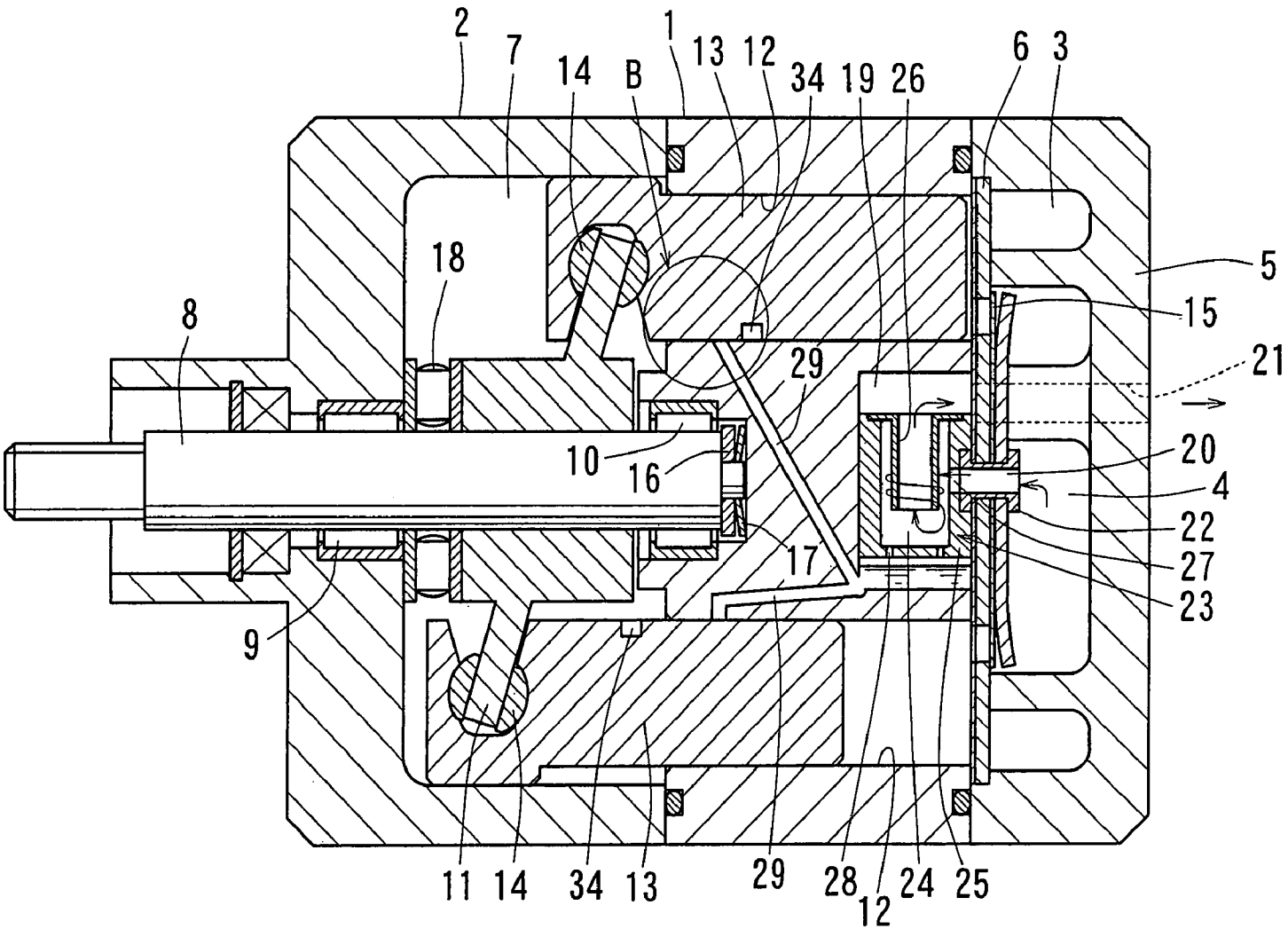
FIG. 4 is a cross-sectional diagram showing a compressor relating to another embodiment.
Figure 5:
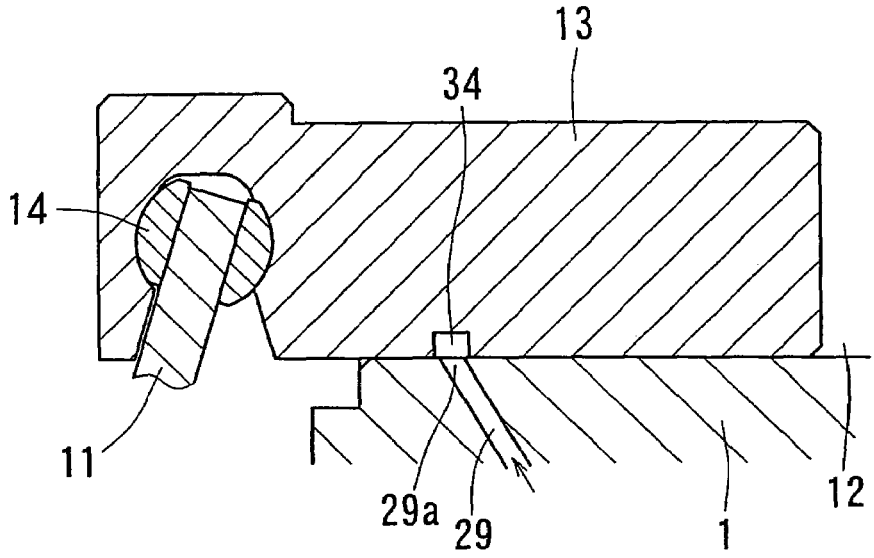
FIG. 5 is a magnified view of Area B in FIG. 4, showing the state in which the groove for discharging oil communicates with the oil supply hole.
Figure 6:
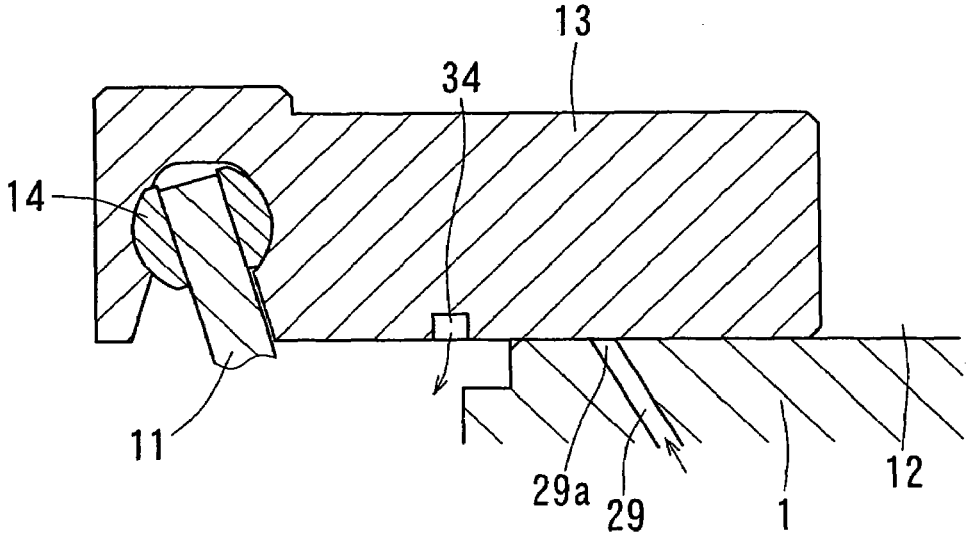
FIG. 6. is a magnified view of Area B in FIG. 4, showing the state in which the groove for discharging oil communicates with the drive chamber.

Next, another embodiment of the present invention will be explained based on FIG. 4 through FIG. 6. As shown in the figures, the inlet of the oil supply hole 29 provided in the cylinder block 1 opens to the bottom of the oil separator 23 while an outlet 29*a* opens to the internal surface of the cylinder bore 12.

Further, a lubricating oil transport groove (or a concave area) 34, which can alternately communicate with the outlet 29*a* of the oil supply hole 29 and the drive chamber 7 during the reciprocating movements of the piston 13, is defined on the external surface of the piston 13. That is, the groove 34 comprises a lubricating oil transport area for intermittently transporting the lubricating oil supplied from the oil supply hole 29 to the drive chamber 7, which is at a lower pressure.

The groove 34 is positioned such that it crosses or matches the outlet 29*a* of the oil supply hole 29 when the piston 13 moves toward the top dead center (during a compression and discharge stroke) and such that the groove 34 extends outside of the cylinder bore 12 and communicates with the drive chamber 7 when the piston 13 is positioned at the bottom dead center (at the end of an suction stroke).

Therefore, the lubricating oil that has been separated from the discharged refrigerant by the oil separator 23 is supplied via the oil supply hole 29 to and lubricates the sliding surface between the piston 13 and the cylinder bore 12. In this case, the lubricating oil that has been supplied from the oil supply hole 29 flows into the groove 34 when the groove 34 communicates with the outlet 29*a* of the oil supply hole 29 during the transition of the piston 13 toward the top dead center, and is discharged to drive the chamber 7 and lubricates the sliding surface between the swash plate 11 and the shoe 14 when the groove 34 communicates with the drive chamber 7 when the piston 13 moves to the bottom dead center.

That is, according to the present embodiment, for each reciprocating movement of the piston 13, the lubricating oil that is supplied from the oil supply hole 29 can be intermittently discharged to drive the chamber 7 by actively transporting the lubricating oil to drive the chamber 7. Therefore, according to the present embodiment, as in the embodiment described above, the stagnation of foreign substances inside the oil supply hole 29 can be avoided, thereby preventing clogging, and at the same time, performance degradation due to refrigerant leakage can be avoided by reducing the leakage of the discharged refrigerant, and the boring process can be simplified by setting the diameter of oil supply hole 29 to be large.

Note that the present invention is not limited to the above embodiments, and may be modified as needed as long as such modifications do not deviate from the essential nature of the invention.

For example, although the single groove 32 for transporting lubricating oil was provided on the external surface of the rotating member 30, two or three grooves 32 may also be used. It is also acceptable to form the rotating member 30 integrally with the drive shaft 8.

Further, although the groove 34 that has a predetermined size for transporting lubricating oil was provided in the area in the external surface of the piston 13 that faces the outlet 29*a* of the oil supply hole 29, the groove 34 may also be formed in a ring shape around the entire perimeter of the external surface.

Also, although the destination of the lubricating oil to be intermittently transported was the drive chamber 7, it is acceptable to provide an oil collection chamber separately from the drive chamber 7 and to transport the lubricating oil there. The key is that any chamber is acceptable as long as its pressure is lower than the discharge side and it can store the lubricating oil.

Furthermore, the present invention can naturally be applied to other compressors in addition to the swash plate types shown in the figures, and the oil separator 23 also need not be limited to the centrifugal type shown in the figures, and other types may be used without any problems.

INDUSTRIAL APPLICABILITY

As explained in detail above, the present invention can, in a compressor, prevent clogging of the lubricant oil supply hole by foreign substances, such as sludge, and can avoid performance degradation due to the leakage of the discharged refrigerant.

The invention claimed is:

1. A compressor having an oil supply area, a lubrication target area to be lubricated, and a lubricating oil transport area for intermittently transporting lubricating oil to said lubrication target area by alternately communicating with said oil supply area and said lubrication target area.

2. The compressor according to claim 1, further defined in being a reciprocating compressor, wherein said lubricating oil is a lubricating oil that has been separated from a discharged refrigerant by an oil separator, and is guided to the lubrication target area due to a pressure difference between a discharge side and a suction side of the compressor.

3. The compressor according to claim 2, wherein said refrigerant is carbon dioxide.

4. The compressor according to claim 1, wherein said lubricating oil transport area comprises a groove defined on an external surface of a rotating member, and alternately communicates with an outlet of said oil supply area and an inlet of a discharge hole connected to said lubricating oil transport area due to rotational movement of said rotating member.

5. The compressor according to claim 4, wherein said rotating member is positioned adjacent to a bearing that rotatably supports a drive shaft and is provided to rotate together with said drive shaft, and additionally, the lubricating oil supplied from said oil supply area is supplied to said bearing via a gap between said rotating member and a circular hole that supports said rotating member.

6. The compressor according to claim 1, wherein said lubricating oil transport area comprises a groove defined on an external surface of a piston that reciprocates inside a cylinder bore, and alternately communicates with an outlet of said oil supply area and said lubrication target area due to reciprocating movement of said piston.

7. A method for lubricating a compressor having a lubricating oil supply area, a lubrication target area to be lubricated, and a lubricating oil transport area, wherein the lubricating oil in said oil supply area is intermittently transported to said lubricating oil transport area by having said lubricating oil transport area alternately communicate with said oil supply area and said lubrication target area.

* * * * *